US011607731B2

(12) United States Patent
Zakotnik et al.

(10) Patent No.: US 11,607,731 B2
(45) **Date of Patent: *Mar. 21, 2023**

(54) CASTER ASSEMBLY

(71) Applicant: Urban Mining Company, San Marco, TX (US)

(72) Inventors: Miha Zakotnik, Austin, TX (US); Davide Prosperi, Austin, TX (US); Gojmir Furlan, Austin, TX (US); Catalina O. Tudor, Austin, TX (US); Alex Ivor Bevan, Austin, TX (US)

(73) Assignee: Noveon Magnetics Inc., Perryville, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/181,420

(22) Filed: Feb. 22, 2021

(65) Prior Publication Data

US 2021/0229178 A1 Jul. 29, 2021

Related U.S. Application Data

(63) Continuation of application No. 16/325,881, filed as application No. PCT/US2017/047103 on Aug. 16, 2017, now Pat. No. 10,926,333.

(Continued)

(51) Int. Cl.
*B22F 9/08* (2006.01)
*C22C 38/00* (2006.01)

(Continued)

(52) U.S. Cl.
CPC ..... *B22F 9/082* (2013.01); *B22D 11/0611* (2013.01); *B22D 11/22* (2013.01);

(Continued)

(58) Field of Classification Search
CPC ..... B22F 9/082; B22F 1/065; B22F 1/054; B22F 2203/11; C22C 38/005; C22C 38/10; C22C 38/16
See application file for complete search history.

(56) References Cited

U.S. PATENT DOCUMENTS 3,695,795 A 10/1972 Jossick
4,656,331 A 4/1987 Lillquist et al.

(Continued)

FOREIGN PATENT DOCUMENTS

CN 104036945 A 9/2014
DE 112007000673 B4 1/2015

(Continued)

OTHER PUBLICATIONS

International Preliminary Report on Patentability received for PCT Patent Application No. PCT/US2017/047103, dated Feb. 28, 2019, 14 pages.

(Continued)

*Primary Examiner* — Scott R Kastler
(74) *Attorney, Agent, or Firm* — BakerHostetler

(57) ABSTRACT

A caster assembly configured to process and store a material includes a reaction chamber, a storage assembly configured to store material processed in the reaction chamber, and a blower configured to process and store the material. The reaction chamber includes a vessel configured to hold the material in a melted state prior to processing and a powder generating assembly configured to receive the material from the melting vessel. The powder generating assembly includes a feeding chamber and a feeding device disposed at least partially within the feeding chamber. The feeding device includes at least one nozzle configured to inject inert fluid, where the fluid is a gas, liquid, or combination of the two into the feeding chamber and a material inlet through which the material is configured to flow into the feeding (Continued)

chamber to be exposed to the inert fluid, where the fluid is a gas, liquid, or combination of the two.

14 Claims, 6 Drawing Sheets

Related U.S. Application Data

(60) Provisional application No. 62/375,947, filed on Aug. 17, 2016, provisional application No. 62/375,943, filed on Aug. 17, 2016.

(51) Int. Cl.

| | |
|---|---|
| ***B22F 1/054*** | (2022.01) |
| ***B22F 1/065*** | (2022.01) |
| ***C22C 38/10*** | (2006.01) |
| ***C22C 38/16*** | (2006.01) |
| ***H01F 41/02*** | (2006.01) |
| ***B22D 11/06*** | (2006.01) |
| ***B22D 11/22*** | (2006.01) |
| ***C22C 28/00*** | (2006.01) |
| ***H01F 1/055*** | (2006.01) |
| ***H01F 1/057*** | (2006.01) |
| ***H01F 1/058*** | (2006.01) |
| *B22F 1/052* | (2022.01) |

(52) U.S. Cl.

CPC ..... *B22F 1/054* (2022.01); *B22F 1/065* (2022.01); *C22C 28/00* (2013.01); *C22C 38/00* (2013.01); *C22C 38/002* (2013.01); *C22C 38/005* (2013.01); *C22C 38/10* (2013.01); *C22C 38/16* (2013.01); *H01F 1/058* (2013.01); *H01F 1/0557* (2013.01); *H01F 1/0577* (2013.01); *H01F 41/0253* (2013.01); *B22F 1/052* (2022.01); *B22F 2009/088* (2013.01); *B22F 2009/0824* (2013.01); *B22F 2009/0884* (2013.01); *B22F 2009/0888* (2013.01); *B22F 2009/0892* (2013.01); *B22F 2203/11* (2013.01); *B22F 2301/355* (2013.01); *B22F 2304/054* (2013.01); *B22F 2304/056* (2013.01); *B22F 2998/10* (2013.01); *B22F 2999/00* (2013.01); *C22C 2202/02* (2013.01)

(56) References Cited

U.S. PATENT DOCUMENTS

| | | | | |
|---|---|---|---|---|
| 5,263,689 | A | 11/1993 | Menzies et al. | |
| 5,888,416 | A | 3/1999 | Ikuma et al. | |
| 6,022,424 | A | 2/2000 | Sellers et al. | |
| 6,808,677 | B2 | 10/2004 | Konishi | |
| 9,044,834 | B2 | 6/2015 | Zakotnik et al. | |
| 9,067,284 | B2 | 6/2015 | Zakotnik et al. | |
| 9,095,940 | B2 | 8/2015 | Zakotnik et al. | |
| 9,144,865 | B2 | 9/2015 | Zakotnik et al. | |
| 9,336,932 | B1 | 5/2016 | Zakotnik et al. | |
| 10,926,333 | B2 * | 2/2021 | Zakotnik ..... | B22F 1/054 |
| 2002/0092376 | A1 | 7/2002 | Nozawa | |
| 2006/0054245 | A1 | 3/2006 | Liu et al. | |
| 2008/0141827 | A1 | 6/2008 | McWhorter | |
| 2009/0035171 | A1 | 2/2009 | Kawamura et al. | |
| 2015/0294786 | A1 | 10/2015 | Zakotnik et al. | |

FOREIGN PATENT DOCUMENTS

| | | | |
|---|---|---|---|
| EP | 0017723 | A1 | 10/1980 |
| FR | 2887162 | A1 | 12/2006 |
| JP | 3432858 | B2 | 8/2003 |
| WO | 92/05903 | A1 | 4/1992 |
| WO | 2014/205002 | A2 | 12/2014 |
| WO | 2015/093672 | A1 | 6/2015 |
| WO | 2016/025794 | A1 | 2/2016 |
| WO | 2017/132075 | A1 | 8/2017 |
| WO | 2018/035202 | A1 | 2/2018 |

OTHER PUBLICATIONS

International Preliminary Report on Patentability received for PCT Patent Application No. PCT/US2017/047108, dated Feb. 28, 2019, 10 pages.

International Search Report and Written Opinion received for PCT Patent Application No. PCT/US2017/047103, dated Jan. 11, 2018, 18 pages.

International Search Report and Written Opinion received for PCT Patent Application No. PCT/US2017/047108, dated Nov. 21, 2017, 12 pages.

Li et al. (Waste Nd-Fe-B Sintered Magnet Recycling by Doping with Rare Earth Rich Alloys), IEEE Transactions on Magnetics, vol. 50, No. 12, Dec. 2014 (Year: 2014).

Zakotnik et al: "Commercial-scale recycling of NdFeB-type magnets with grain boundary modification yields products with 'designer properties' that exceed those of starting materials", Waste Management., vol. 44, Oct. 1, 2015, pp. 48-54.

U.S. Appl. No. 16/325,881, filed Feb. 15, 2019.

* cited by examiner

CASTER ASSEMBLY

CROSS-REFERENCE TO RELATED APPLICATIONS

This present application is a continuation of U.S. patent application Ser. No. 16/325,881, filed Feb. 15, 2019, now U.S. Pat. No. 10,296,333, which is a National Stage Application filed under 35 U.S.C. 371 of International Patent Application No. PCT/US2017/047103 filed Aug. 16, 2017, which claims the benefit of priority to U.S. Patent Applications Nos. 62/375,947 and 62/375,943, both filed Aug. 17, 2016, the contents of which are both incorporated by reference herein for all purposes.

TECHNICAL FIELD

The present disclosure is directed to caster assembly that is configured to prepare, store, and form materials, such as metal powder, and associated methods. In particular, the caster assembly may be used to process rare earth containing material(s) into permanent performance magnetic materials or other functional materials.

BACKGROUND

Powder metallurgy describes processes in which metal powders are used to produce a wide range of materials or components. Such processes result in homogenous, yet compositionally complex materials. For example, in some processes, fine metal powders of individual metals are mixed with binders, such as lubricant wax or other low melting temperature material(s), and compressed into a "green body" of the desired shape, and then the green body is heated in a controlled atmosphere to bond the material by sintering. In some cases, these green bodies further comprise metallic grain boundary-forming metal(s). In other cases, magnetic materials can be incorporated into polymer composites to form bonded magnets.

The chemical and physical homogeneity of the precursor powders is, in many cases, critical to the formation and ultimate performance of the cast and sintered or polymer-processed materials made through such a powder metallurgical route. It is desirable, for example, to provide mixtures of metal powder particles of tightly controlled sizes, for example with one or more mono-dispersed size distributions, each having narrow variances with respect to the mean particle size (e.g., bi-, tri-, or polymodal distributions of specific individually monodispersed particles) to improve efficiency of packing or mixing.

The present invention is directed to a caster apparatus and associated methods that may be used to make atomized powders, strip casted flakes, and bulk alloy objects. The present invention also shows how material produced from the caster apparatus or similar material can be processed into a permanent magnet materials.

SUMMARY

In one aspect of the present disclosure, a caster assembly is configured to process a stored charge of material into various products with different morphologies. The caster assembly generally includes a reaction chamber in which the material is processed. The reaction chamber includes a pot or vessel configured to hold the charge material in a melted state prior to subsequent processing. A powder generating assembly may be configured to receive the material from the melting pot or vessel, and includes a feeding chamber and a feeding device disposed at least partially within the feeding chamber. The feeding device preferably includes at least one nozzle configured to inject inert fluid, where the inert fluid is a gas, liquid, or combination of the two into the feeding chamber and a material inlet through which the material is configured to flow into the feeding chamber to be exposed to the inert fluid, where the fluid is a gas, liquid, or combination of the two. The caster assembly may further include a storage assembly, configured to collect and store the material, that includes a storage container, a manifold that connects the feeding device to the storage container, and a valve that controls flow of the material from the feeding device to the storage container through the manifold. The caster assembly may also include a blower assembly, such as a booster assembly, configured to provide inert fluid, where the fluid is a gas, liquid, or combination of the two through the at least one nozzle to form the material and transport the material to the storage container.

In another aspect of the present disclosure, a reaction chamber for a caster assembly configured to process material includes a tundish configured to hold the material in a melted state prior to solidification. The caster assembly may be configured to process the material into three forms. The reaction chamber further includes a powder generating assembly configured to selectively receive material from the tundish. The powder generating assembly includes a feeding chamber and a feeding device disposed at least partially within the feeding chamber. The feeding device includes at least one nozzle configured to inject inert fluid, where the fluid is a gas, liquid, or combination of the two into the feeding chamber. The feeding device further includes a material inlet through which the material is configured to flow into the feeding chamber to be exposed to the inert fluid, where the fluid is a gas, liquid, or combination of the two. The reaction chamber may also include a flake generating assembly that has a wheel configured to selectively receive material from the tundish. Additionally, the reaction chamber may have a book molding assembly that includes a book mold within the assembly chamber.

In yet another aspect of the present disclosure, a caster assembly, configured to process and store material, may include a reaction chamber in which the material is processed. The reaction chamber preferably includes a pot vessel configured to hold the material in a melted state prior to processing and a powder generating assembly configured to receive material from the melting pot vessel. The powder generating assembly includes a feeding chamber that preferably extends about a center axis and a feeding device disposed at least partially within the feeding chamber. The feeding device includes at least a first nozzle and a second nozzle. The first nozzle can be configured to inject a first inert fluid into the feeding chamber in a first direction, where the first inert fluid is a gas, liquid, or combination of the two. The second nozzle can be configured to inject a second inert fluid into the feeding chamber in a second direction, where the second inert fluid is a gas, liquid, or combination of the two and the second inert fluid is the same as or different from the first inert fluid, and where the first direction is different from the second direction. The feeding device can also include a material inlet through which the material is configured to flow into the feeding chamber in a third direction to be exposed to at least the first and second inert fluids.

BRIEF DESCRIPTION OF THE DRAWINGS

The foregoing summary, as well as the following detailed description of illustrative embodiments of the caster assembly of the present application, will be better understood when read in conjunction with the appended drawings. For the purposes of illustrating and describing the various aspects and embodiments of the caster assembly of the present application, there is shown in the drawings illustrative embodiments. It should be understood, however, that the application is not limited to the precise arrangements and instrumentalities shown. In the drawings.

DETAILED DESCRIPTION OF THE ILLUSTRATIVE EMBODIMENTS

Aspects of the disclosure will now be described in detail with reference to the drawings, wherein like reference numbers refer to like elements throughout, unless specified otherwise. Certain terminology is used in the following description for convenience only and is not limiting.

Figure 1:
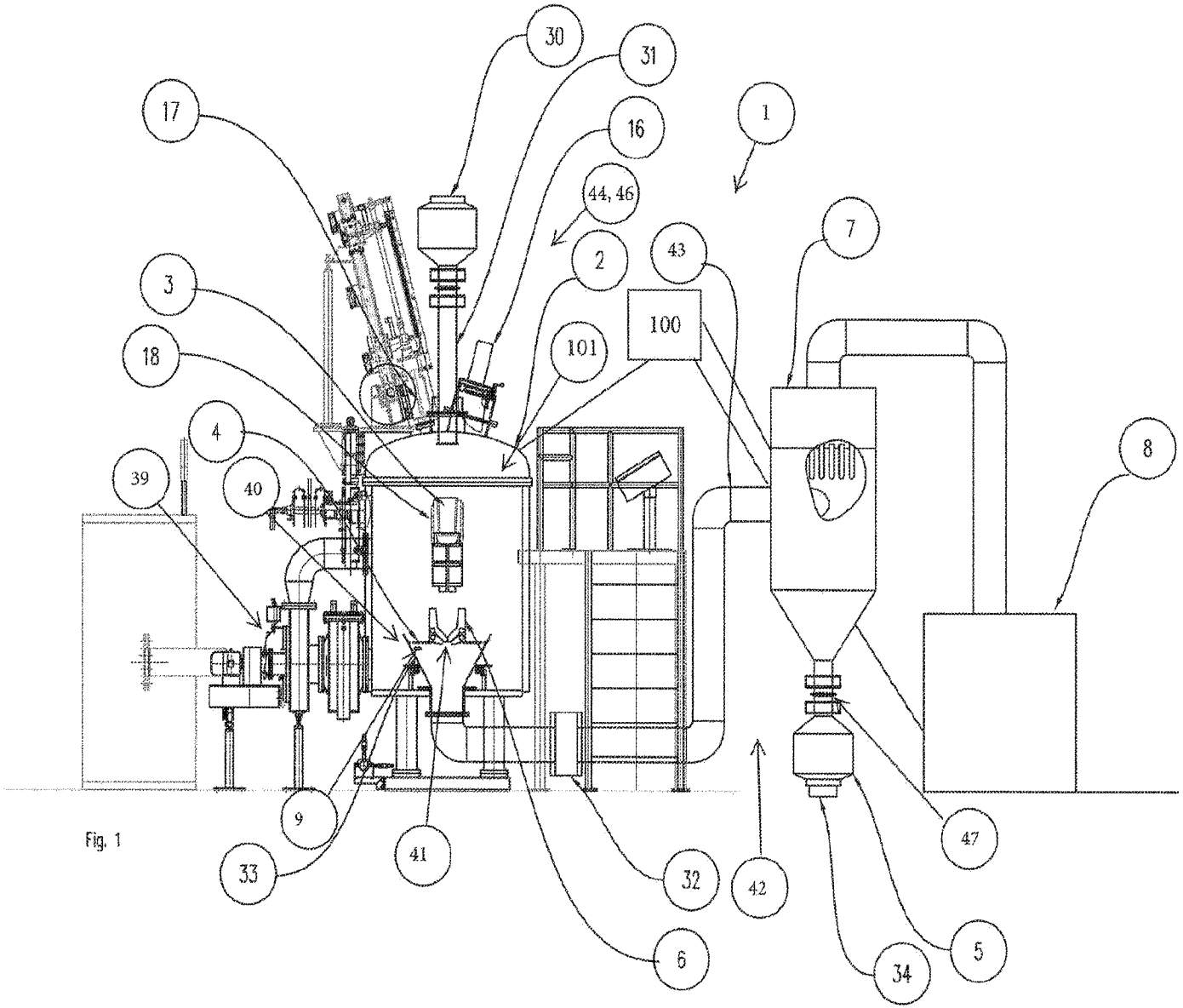
FIG. 1 is a schematic of an exemplary caster assembly, including a reaction chamber, a storage assembly, and a blower assembly.

Referring to FIG. 1, a caster assembly 1 is configured to process and store material, such as a metal or metallic alloy. As shown in this figure, the caster assembly 1 typically includes a reaction chamber 2 in which the material is processed and a storage assembly 42 that, in coordination with at least one blower assembly 8, is configured to transport the material from the reaction chamber 2 to a storage container 5. Blower assembly 8 may be a booster assembly. For example, the booster assembly may have a closed loop and be coupled to at least one of a compressor, a turbine, and a heat exchanger. The booster assembly may also be configured to produce a pressure differential of at least 0.5 bar (0.725 psi) or at least 1 bar (14.5 psi).

The caster assembly 1 can also include a control system 100 that includes a temperature control assembly 44 configured to monitor and control temperature within the reaction chamber 2.

The reaction chamber 2 typically includes a heater 18, such as an induction regulated heater configured to heat the material, for example, in a pot 3, such as a melting pot. Control system 100 may be configured to control heater 18 to provide a target melting temperature for the material, such as, for example, 1500° C. Material may be melted within reaction chamber 2 by heater 18. Alternatively, material may be pre-melted prior to being moved to reaction chamber 2, or pre-melted prior to being moved to reaction chamber 2 and then re-melted in heater 18. Caster assembly 1 may be water cooled.

The reaction chamber 2 further includes a tundishes 21, 25 configured to hold the material in a melted state prior to processing. Tundish 25 may be fixed and have a channel to pour molten metal into the book molding assembly 52 or the powder generating assembly 40. Tundish 25 may also have a cavity with an opening at the bottom to distribute molten metal onto a wheel 28 of the flake generating assembly 50.

Figure 4:
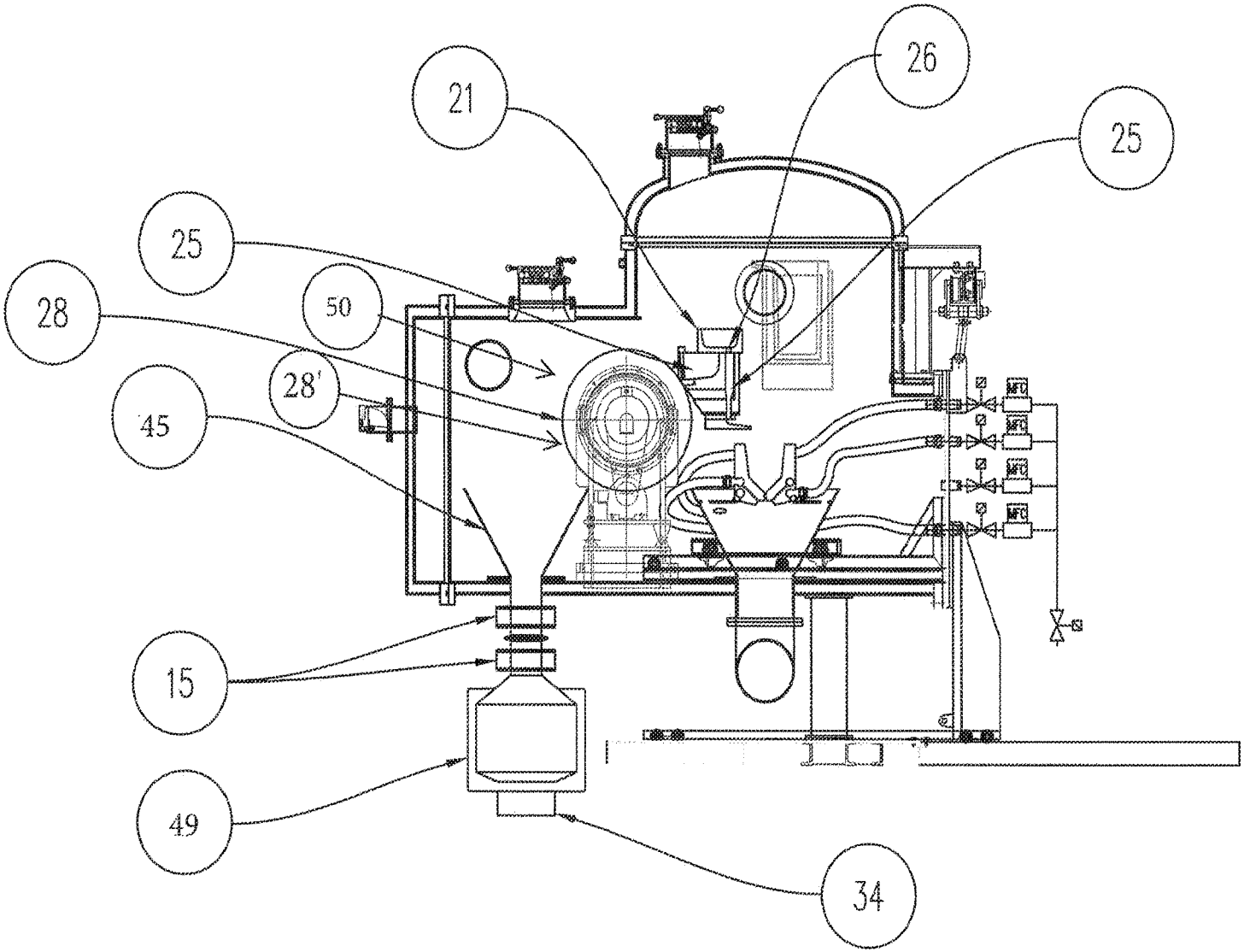
FIG. 4 is an expanded schematic of the powder generating assembly and a flake generating assembly of the reaction chamber shown in FIG. 1.

A position of the tundish 21 may be moved or positioned relative to a material processing assembly, such as a powder generating assembly 40, a flake generating assembly 50 (FIG. 4), and/or a book molding assembly 52 (FIG. 5) so that the tundish may supply material to one of the powder generating assembly 40, the flake generating assembly 50, and/or the book molding assembly 52. Tundish 21 can rotate and pour molten metal into the cavity or vertical channel. FIG. 4 depicts tundish 21 in position to pour molten metal into the powder generating assembly 40 through a hole 26 in the bottom of the tundish 21. In one configuration, the tundishes 21, 25 may be positioned so as to provide material to the flake generating assembly 50. In another configuration, the tundishes may be positioned, for example rotated, so as to provide material away from the flake generating assembly 50 and to either of the powder generating assembly 40 or the book mold assembly 52. For example, the reaction chamber 2 may include a structure such as a drawer in which the powder generating assembly 40 and the book mold assembly 52 interchangeably fit. In this example, the drawer may be opened by an operator, and either of the powder generating assembly 40 and the book mold assembly 52 removed, prior to placing the other assembly in the drawer. When the drawer is closed, it forms an air-tight seal with the rest of the chamber.

In some embodiments, control system 100 may be used to remotely control the position of the tundish 21 in order to provide material to one of the powder generating assembly 40, the flake generating assembly, and the book mold assembly 52. By having a caster assembly 1 with a reaction chamber 2 and corresponding control system 100 configured to produce three products: atomized powders, strip casted flakes, and bulk alloy objects, several advantages are realized, including reduced space, improved quality control, operational multi-tasking, and increased particle size range.

For example, control system 100 may rotate tundish 21 to feed material to one of the powder generating assembly 40, the flake generating assembly 50, and the book molding assembly 52, which are stationary. Alternatively, the material processing assemblies may rotate relative to the tundish 25, which is stationary. In yet another alternative, both the tundish 25, and the material processing assemblies may rotate relative to one another such that none of the tundish 25 and the material processing assemblies are stationary.

Figure 2:
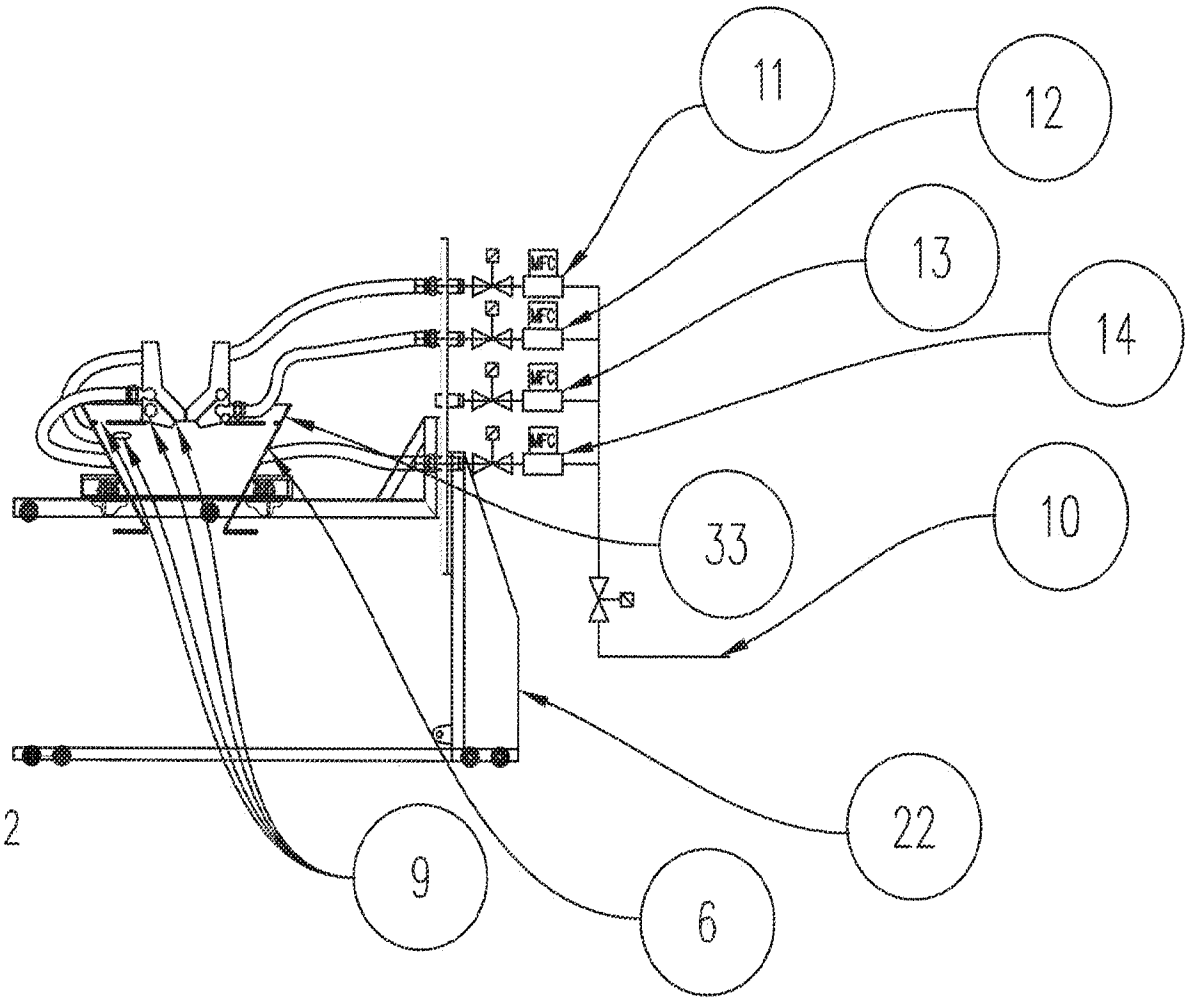
FIG. 2 is a schematic of an exemplary powder generating assembly of the reaction chamber shown in FIG. 1.
Figure 3:
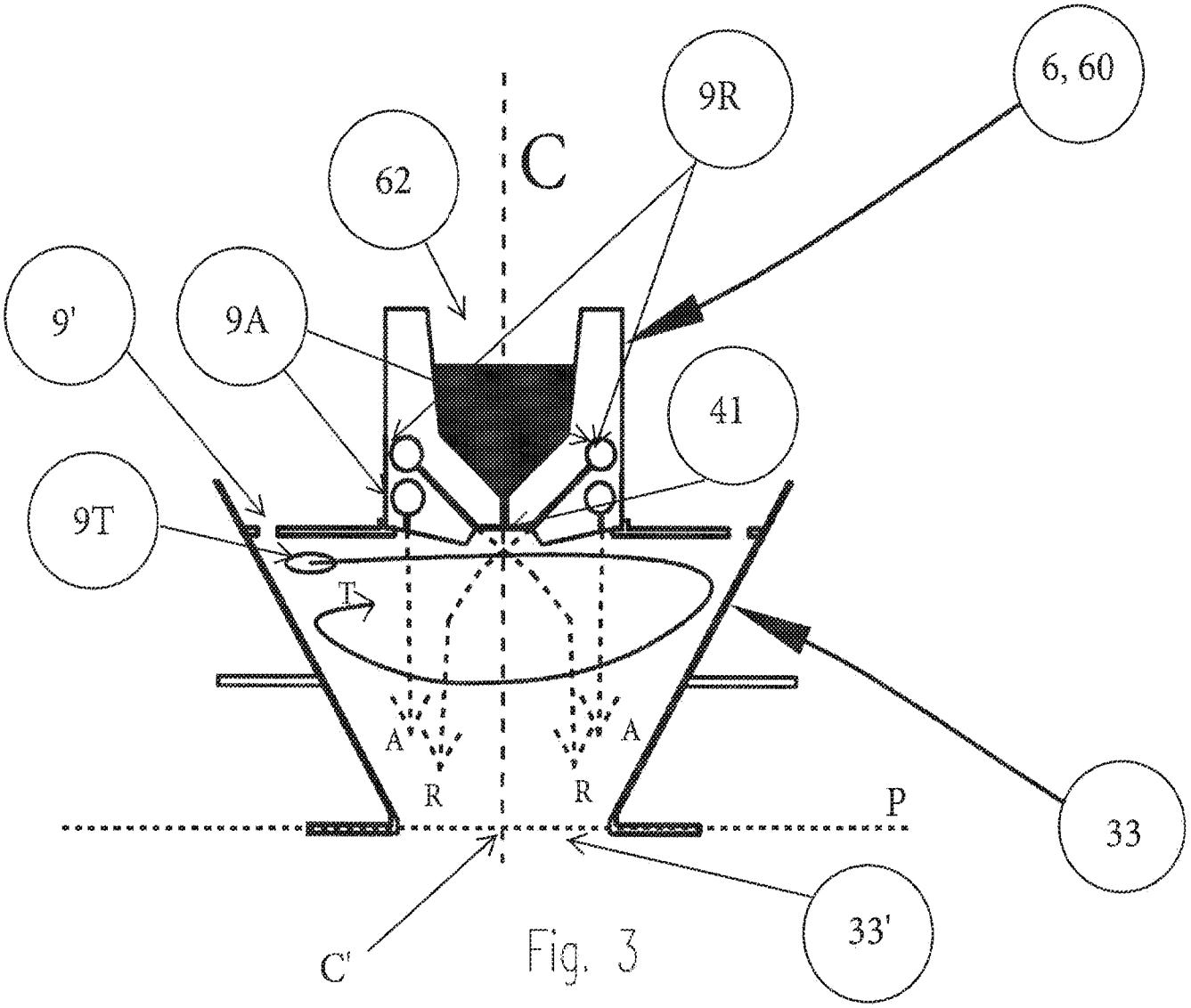
FIG. 3 is an expanded schematic of the powder generating assembly shown in FIG. 2.

With reference now to FIGS. 2 and 3, the powder generating assembly 40 may be configured to receive material from the pot 3, for example, via the tundish 25. As shown in FIGS. 2 and 3, the powder generating assembly 40 may include a feeding chamber 33 in which the material is processed by an inert fluid, where the fluid is a gas, liquid, or combination of the two and a feeding device 6 that is disposed at least partially within the feeding chamber. The feeding chamber 33 defines an outlet 33' that has a centerpoint C' and lies in a plane P. Feeding chamber 33 extends vertically about a center axis C that is perpendicular to plane P and includes centerpoint C'. Feeding chamber 33 may have a shape that is circular in cross-section according to cross-sections taken along planes parallel to plane P and perpendicular to center axis C. For example, feeding chamber 33 may have a cylindrical with conical bottom shape or conical or frusto-conical shape, or a semi-spherical or partially semi-spherical shape that extends along a center axis C. Feeding chamber 33 may have a relatively wider diameter upstream relative to downstream. The narrowing diameter of the feeding chamber 33 may facilitate collection of the powder.

The feeding device 6 may also include a body 60 that defines a reservoir 62 and a material inlet 41 that connects the reservoir to the feeding chamber 33. As shown, reservoir 62 typically extends along the center axis C and may have a shape that is circular in cross-section according to cross-sections taken along planes parallel to plane P and perpendicular to center axis C. For example, feeding chamber 33 may have a conical or frusto-conical shape, or a semi-spherical or partially semi-spherical shape that extends along a center axis C. Feeding chamber 33 may have a relatively wider diameter upstream relative to downstream so as to facilitate passage of the material from reservoir 62 through material inlet 41 into the feeding chamber 33.

The feeding device 6 further includes at least one nozzle 9 that is mounted on the body 60 by brackets 4 and configured to deliver the inert fluid to the feeding chamber 33. The at least one nozzle 9 may include a first nozzle 9 configured to inject the inert fluid in a first direction, a second nozzle configured to inject the inert fluid in a second direction, a third nozzle configured to inject the inert fluid in a third direction, a fourth nozzle configured to inject the inert fluid in a fourth direction, and a fifth nozzle configured to inject the inert fluid in a fifth direction. Each of the nozzle directions may have a component that is tangential, radial, or axial direction relative to the center axis C. Each of the nozzle directions may be different. Alternatively, some of the nozzle directions may be the same or approximately the same, such as parallel to one another or having angles relative to the center axis C that are within 5° of one another. One or more of the directions may intersect or be skew to the center axis C.

With reference to the arrows shown in FIG. 3, some nozzles 9A may direct the inert fluid in an axial direction A, that is parallel or approximately parallel to center axis C. Other nozzles 9R may direct the inert fluid in a radial, or partially radial direction R away from center axis C. For example, direction R may include axial and radial components. Other nozzles 9T may direct inert fluid tangentially or partially tangentially about the center axis C. While a nozzle providing for tangential flow is shown as being delivered laterally from the below the inlet 41 (e.g., upper third of the reaction chamber along axis C), in certain other embodiments, this nozzle may be disposed downstream along axis C closer to the middle (e.g., middle third), or or bottom (e.g., bottom third) of the feeding chamber 33. This nozzle may be configured to provide flow directed upward, downward or perpendicular relative to axis C.

The flow of the inert fluid from at least some of nozzles 9 may be configured to create a vacuum and a flow of material from the reservoir 62 through material inlet 41 so as to form ultra-fine particles, for example, in the 80 nanometer to 500 micron range. In some embodiments, the conditions may be configured to provide particles in one or more of the ranges of from 80 nm to 100 nm, from 100 nm to 250 nm, from 250 nm to 500 nm, from 500 nm to 1000 nm, from 1 micron to 5 microns, from 5 microns to 10 microns, from 10 micron to 25 microns, from 25 microns to 50 microns, from 50 microns to 100 microns, from 100 microns to 250 microns, or from 250 micron to 500 microns, Typically, the rate at which the material passes through inlet 41 depends on the material's weight/density, the inlet diameter, and a pressure differential $\Delta P = P1 - P2$ which is applied/maintained across the powder generating assembly 40. This pressure differential may be on the order of 200 to 800 millibar, for example, 400 to 600 millibar. In some embodiments, the conditions may be configured to provide pressure differentials in one or more of the ranges of from 200 to 300 millibar, from 300 to 400 millibar, from 400 to 500 millibar, from 500 to 600 millibar, from 600 to 700 millibar, or from 700 to 800 millibar At least some of nozzles 9 may also subject the material to impingement by one or more oblique streams of inert fluid so as to form the particles by producing a dispersion of substantially spherical solid particles of the metallic alloy within the stream(s) of inert fluid. Each nozzle 9 may provide the same or different inert fluid (compositions, phases, velocities, etc.) to the feeding chamber 33. While nozzles 9 are shown as individual feeds, each nozzle 9 may comprise a plurality of feeds, for example, radially distributed about the hypothetical axis N along with the nozzle is elongate. The material, such as molten/liquid metallic alloy, may be introduced to the stream(s) in a hot zone of a tangential reactor, where the hot zone may be maintained at a temperature controlled to within ±10° C. variance or within ±5% of a set temperature. The tangential stream(s) from one of nozzles 9 provides a vortex within the feeding chamber 33, within which is the hot zone—i.e., the temperature at the center of the feeding chamber 33 is hotter than at the sides. Once formed, the substantially spherical solid particles of the metal or metallic alloy are separated from the stream(s) by filtration and gravity.

Obviously, the specific parameters are defined by the specific materials being processed and the desired form of the product, but the person of skill in the art would be able to define these parameters without undue experimentation.

The energy delivered by oblique impingement by nozzles 9 disperses the material (such as molten or liquid metal or metal alloy) into the nano- or micro-scale particles. While dispersing the material into the nano- or micro-scale particles, the impinging stream imparts a radial component to the direction of the particles, directing them away from the center axis C and into the vortex generated by the tangential stream(s). The specific size of the particles may be controlled, for example, by controlling the parameters associated with this impingement, including, but not necessarily limited to the angle of the oblique impingement, the velocity of the stream(s), and the physical nature (heat capacity, temperature, and density) of the stream(s).

The velocity, angle, and density of the impinging stream(s) define the energy applied to dispersing the material into the nano- or micro-scale particles which, in turn, affect the size of the initially formed particles and the time spent solidifying within the hot zone. While the angle of impingement may be any angle from greater than zero degrees to less than 180 degrees, for example in one or more decade increment from 0 to 180 degrees, in some embodiments, the oblique angle is in a range of 10° to less than 90°, preferable in a range of from about 30° to about 60°. In some cases, this provides for the use of a useful range of velocities while maintaining useful particle longevity in the hot zone of the vortex.

In some embodiments, the narrowing of the feeding chamber 33 downstream may create a Venturi effect as the formed particles pass out of the feeding chamber 33 into the storage assembly 42. Nozzles 9 may be disposed upstream of, downstream of, or at the same point as material inlet 41 relative to the feeding chamber. When disposed below inlet 41, nozzles 9, configured to impinge material passing from inlet 41, may be directed upward relative to axis C.

The inert fluid may also pass through inlets 9'. Inlets 9' may be defined or partially defined by the chamber 33 and/or brackets 4. Brackets 4 may define inlets 9' about center axis C. For example, brackets 4 may define four, six, or eight equidistantly spaced inlets disposed about center axis C. The inert fluid may be drawn into chamber 33 by the vacuum created by nozzles 9.

The flow from nozzles 9 and inlets 9' may also remove particles from an inner surface of the feeding chamber 33. The flow, for example, of the nozzles 9 that direct the inert fluid in the axial direction A, may also transport the particles from the reaction chamber 2 into the storage assembly 42. For example, the blower assembly 8 may supply inert fluid through nozzles 9 that transports the particles from the chamber 33 through a manifold 43, into a filter 7, through a valve 47, and into the storage container 5. In this way, transport of the material from the reaction chamber 2 to the storage container may avoid exposure to ambient air. The inert fluid may circulate back into the reaction chamber 2 after entering the filter 7. For example, filter 7 may include a corona discharge neutralizer and an electromagnet to aggregate particles in the gas stream to be bigger than 1 micron. The particles may then be removed from the filter with reverse pulse jet cleaning device into the container 5. Function of electromagnet is to magnetize all particles so they can form aggregates.

Storage assembly 42 may include a force transducer 34 that, in conjunction with the control system 100, is configured to measure a weight of the material in the container 5. For example, a standard force transducer may be used that employs a strain gauge that changes resistivity with mechanical deformation so as to measure ΔV on a Wheatstone bridge that is coupled with strain gauge.

With reference to FIG. 2, the inert fluid may be supplied to the nozzle(s) 9 from the blower assembly 8, such as an assembly that includes a compressor via pipe 10 and flow management components 11, 12, 13, 14. Each flow management component 11, 12, 13, 14 includes a mass flow control meter and a valve that, in conjunction with control system 100, control flow of the inert fluid through the nozzles. Each flow management component 11, 12, 13, 14 may be configured to provide the same or different inert fluid to each nozzle 9. Additionally, each flow management component 11, 12, 13, 14 may be configured to provide inert fluid at different temperatures. For example, a first nozzle 9 may provide a first inert fluid at a relatively high temperature and a second nozzle 9 may be configured to provide a second inert fluid at a relatively low temperature. The flow of inert fluid may be controlled so as to achieve optimum gas velocity and produce optimum spherical powder shape and size. Specifically, the powder may be in the range of 80 nanometers to 500 micrometers, such as 100 nm to 0.3 microns, 100 nm to 0.5 microns, 100 nm to 1 micron, 100 nm to 2 microns 2, and 100 nm to 3 microns including a range of 80 nanometers to 300 micrometers, and have an oxygen content from 0 to 900 ppm, such as 0.01 to 900 ppm, and a carbon content of 0 to 800 ppm, such as 0.01 to 800 ppm. The powder may be based on any melt processable material, such as an NdFeB type compound and have values of carbon and oxygen combined in the range of 0.01 to 1000 or 0.01 to 1700 ppm, respectively.

Any one or more of these described operations may be conducted manually or by computer control, or a combination thereof.

The combinations of materials used to form an alloy, separately, as pure elements, or in a combination of an alloy and pure elements, may include: (i) Nd, Pr, Fe, FeB, and B; (ii) Nd, Fe, Co, Cu, and Dy, (iii) Nd, Fe, Co, Cu, Dy, a composition with a ratio Nd75:Pr25, a composition with a ratio Dy80:Fe20 and Pr, (iv) $Nd_2Fe_{14}B$, (v) $Dy_2Fe_{14}B$, (vi) $Pr_2Fe_{14}B$, (vii) $Tb_2Fe_{14}B$, (viii) $Nd_2Co_{14}B$, (ix) $Pr_2Co_{14}B$, (x) $Tb_2Co_{14}B$, (xi) $Nd_2Ni_{14}B$, (xii) $Pr_2Ni_{14}B$, (xiii) $Tb_2Ni_{14}B$, (xiv) $V_2FeB_2$, (xv) NdFeB (xvi) NbFeB, (xvii) MoFeB, (xviii) ZrFeB, (xix) TiFeB, (xx) Nd-rich, (xxi) $CoNd_3$, (xxii) $NiNd_3$, (xxiii) GaNd, (xxiv) Nd-oxide, (xxv) Pr-oxide, (xxvi) rare earth (RE)-Carbide, (xxvii) Nd-Oxifluoride, (xxviii) Re-Nitride, or (xxix), $In_2O_3$ (xxx), $TiO_2$ (xxxi), CuInGa (xxxii), $CaTiO_3$ (xxxiii), $Y_2O_3$ (xxxiv), CaO (xxxv), $TiO_2$ (xxxvi) $SnO_2$ (xxxvii), $Al_2O_3$ (xxxviii), $ZrO_2$ (xxxix), $Y_2O_3$ (xl), $Fe_2O_3$ (xli), ZnO (xlii), SiC (xliii), $Mo_2C$ (xliv), VC (xlv), CrC (xlvi), TiN (xlvii), $W_2B_5$ (xlviii), $TiB_2$ (xlix), $NbB_2$ (l), CrB (li), $CeB_6$ (lii), $ZrB_2$ (liii), $ZrO_2$ (liv), SS316L (lv) and a combination of two or more of this and including the following compositions:

$Nd_{25.2}Pr_{2.74}Dy_{4.4}Co_1Cu_1Fe_{62.2}Ga_1Gd_{1.5}B_1$, $Nd_{12.95}Fe_{2.21}Dy_{59.27}Tb_{0.24}Al_{0.86}Cu_{3.28}Co_{20.69}Pr_{0.13}Ga_{0.19}C_{0.01}O_{0.17}$, $Nd_{13.44}Fe_{1.88}Dy_{61.54}Tb_{0.25}Al_{0.06}Cu_{3.12}Co_{19.279}Pr_{0.07}Ga_{0.19}C_{0.01}O_{0.17}$, $Nd_{13.95}Fe_{2.21}Dy_{59.27}Tb_{0.24}Al_{0.86}Cu_{3.28}Co_{20.69}Pr_{0.13}Ga_{0.095}Zr_{0.095}C_{0.01}O_{0.07}$, $Nd_{13.95}Fe_{2.21}Dy_{60.07}Tb_{0.24}Al_{0.06}Cu_{3.28}Co_{20.69}Pr_{0.13}Mo_{0.06}Ga_{0.095}Zr_{0.095}C_{0.01}O_{0.01}$, $Nd_{13.95}Fe_{2.21}Dy_{60.07}Tb_{0.24}Al_{0.06}Cu_{3.28}Co_{20.69}Pr_{0.15}Mo_{0.06}Ga_{0.093}Zr_{0.095}C_{0.001}O_{0.001}$,

For example, some or all of the materials may be from pre-processed or waste magnet material. Alternatively, some or all of the materials may be from new magnetic material, e.g., that has not been previously used in a consumer product. Alternatively still, some or all of the materials may be from waste magnet material and new magnetic material. The caster assembly may be configured for the design of nano-powders for a variety of applications, including, for example, photocatalysis based devices, touch screen devices, electromechanical devices, transducers, capacitors, actuators, high-k dielectrics, dynamic random access memory, field effect transistors, logic circuitry, solid rocket fuel, conducting paste, magnetic tapes, fluid, targeted drug delivery, metallic paint, sintering aids, transparent polymer, synthetic bones, etc.

The caster assembly 1 may be configured to maintain 2:14:1 phase grains, or between about 90 to 97 vol. % of those grains, when creating the initial cast alloy flakes or in the case of producing the atomized powders. The caster assembly may also be configured to produce, for example, individual 1 tonne batches of special alloys, such as super alloys, stainless steel grades (SUS 316L), niobium rich alloys, titanium rich alloys, etc., in the form of strip casted flakes, bulk mold, and atomized powder in the range of 100 nanometers to 500 microns.

With reference again to FIG. 1, temperature of the reaction chamber 2 may be controlled by a temperature control assembly 44 of the control system 100. Temperature control assembly 44 includes a thermal imaging device 46 and a pyrometer 16 that is calibrated by a thermocouple 17. Reaction chamber 2 may also include one or multiple sensors 101, such as 12, 13, 14, 15, 16, 17, 18, 19, 20, 21, 22, 23, or 24 sensors configured to, in conjunction with the control system 100, provide a three-dimensional dynamic mapping of the pressure, temperature, and emissivity of hot and cold spots, so as to provide a complete image of the material within the chamber and allow control of the processing of that material. The temperature control assembly 44 can be configured to control temperature in the reaction chamber within 0.1 degrees Celsius. The temperature is controlled by a thermocouple which is coupled with the controller to give a feed back on the temperature. The temperature control assembly 44 is can further be configured to measure emissivity of the different classes of materials. In but one example, assembly 44 can be configured to measure emissivity of wood, charcoal, stainless steel (SUS 316 L), or other metallic and non-metallic materials. Measuring emissivity is used to calibrate the thermal imager so to allow for a reliable temperature reading. The radiation hitting the thermal imager is then contributed by reflected, transmitted, and emitted radiation from the heated body. These four materials listed can be used to build a calibration curve that cover materials, temperature and energy/emissivity ranges to be used in further materials processing.

Temperature control unit 39 may be used in conjunction with the flake generating assembly 50 or the book molding assembly 52. Temperature control unit 39 may include an RF power supply and a blower with a heat exchanger and may be configured to cool the reaction chamber.

During processing, correction of the composition of the material may be accomplished in conjunction with a port 30, which may be on the top or the side of the reaction chamber 2, and a telescoping arm 31, both shown in FIG. 1. Specifically, the caster assembly 1 may be configured to autonomously cycle powder through pneumatic transport back into the pot 3 to correct for targeted compositions by injecting additional material via the port 30 into the pot 3 using the telescoping arm 31. A double gate valve between the main chamber and the port may be used to add new material via port 30 without introducing ambient air. Notably, because force transducer 34 may be used to measure the weight of the material in the storage container 5, a precise weight of additive material may be introduced into the existing material in the reaction chamber 2, while compensating for mass loss for portions of material having a high vapour pressure, such as the elements from group of lanthanides and alkali materials.

The caster assembly 1 may be further configured to load a pre-melted material, such as a metal alloy, in the form of a bullet through the port 30 into the pot 3, where it may then be melted or re-melted so as to provide optimum homogenous composition.

With reference to FIG. 4, the flake generating assembly 50 may include a wheel 28. When the tundish 25 is positioned relative to the flake generating assembly 50 so as to provide the material to the wheel 28, flakes may be formed as material is casted. Specifically, wheel 28 can rotate at a high speed under an inert fluid, such as Ar or He to create cast alloy flakes. Wheel 28 may be water cooled. During this process, cast alloy flakes may be pulverized to create a strip casted flakes, for example, with rare earth concentration higher than 30 wt. %, for example, higher than 31 wt. %, or higher than 32 wt. %, or higher than 33 wt. %, or higher than 34 wt. %, or higher than 35 wt. %, or higher than 36 wt. %, or higher than 37 wt. %, or higher than 38 wt. %, or higher than 39 wt. %, or higher than 40 wt. %, for example up to 60 wt %, 80 wt %, or 100 wt %.

Molten-containing portions of material may be conveyed to a system that rapidly cools the portions, causing fragmentation of adhesive force on the portions with concentrations higher than 60 wt. % that may be attached to parts of the wheel 28 or support housing of the wheel. For example, wheel 28 may be cooled by liquid nitrogen or argon. This cooling process may substantially recover the entire material from the rotating wheel since the material pills off from contracting during cooling, and falls from gravity into a discharge area, such as funnel 45. From funnel 45, material drops through a set of valves 15 into a water cooled storage container 49. Wheel 28 may also include a coating 28', such as a transition metal, preferably silver or silver alloy coating that has, for example, a thickness of between 50 and 200 micrometers, such as at least 100 micrometers or 150 micrometers. This coating 28' may be configured to increase conductivity of the wheel 28 and also to reach supercritical cooling temperature in the range of 10^7 degrees Celsius meters per second (° Cm/s). The coating 28' may provide a low friction surface that reduces attachment of the metal to the wheel 28. For example, silver, silver alloy, ceramic, platinum, platinum based, zirconium, zirconium based, boron nitride, niobium based alloys, titanium nitride, aluminium titanium nitride, chromium nitride, and chromium carbon may provide low friction coatings, and are useful for this purpose. Coatings may be applied using any method known in the art for this purpose, for example chemical vapor deposition, thermoreactive diffusion, and dynamic compound deposition.

Figure 5:
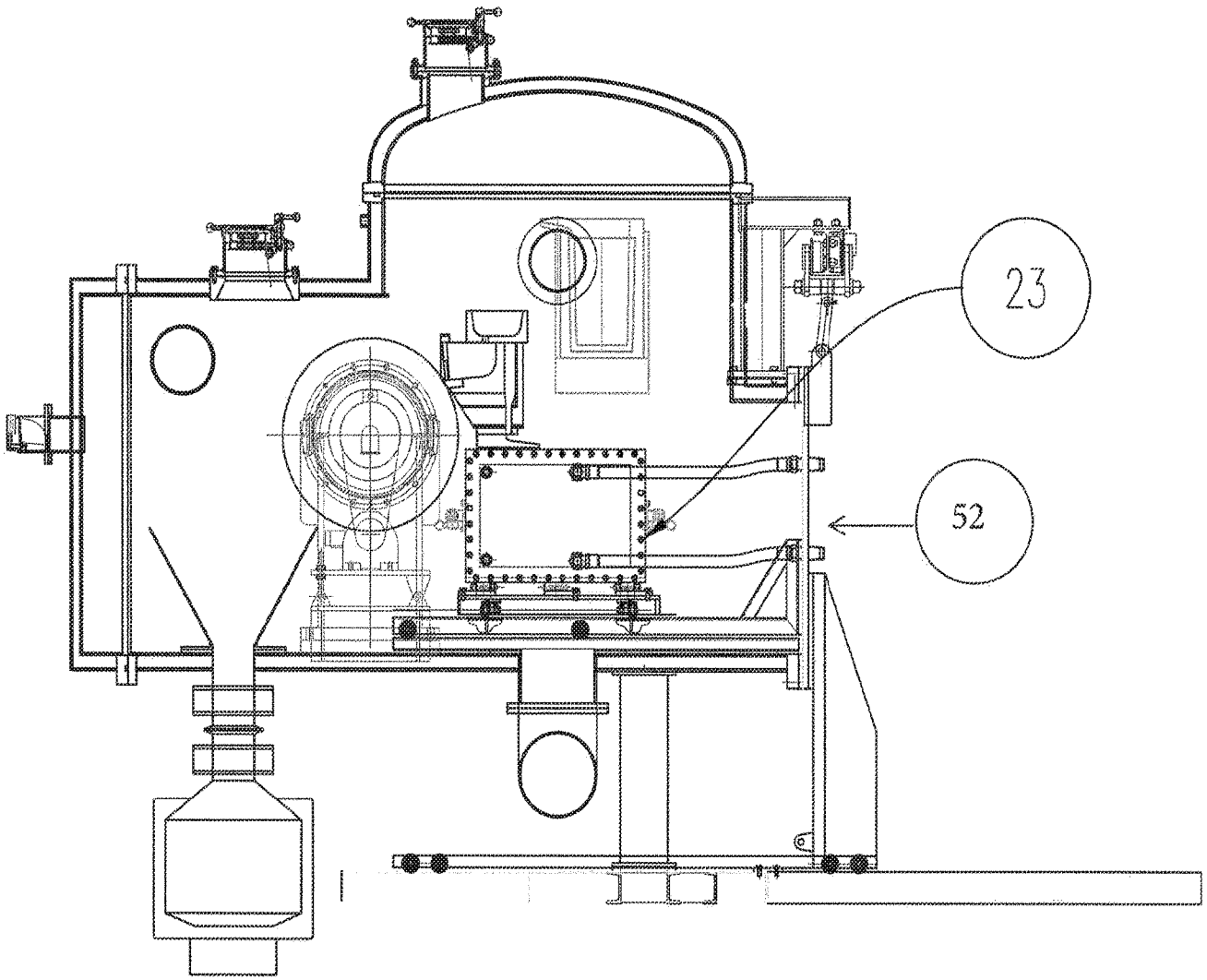
FIG. 5 an expanded schematic of the flake generating assembly and a book molding assembly of the reaction chamber shown in FIG. 1.
Figure 6:
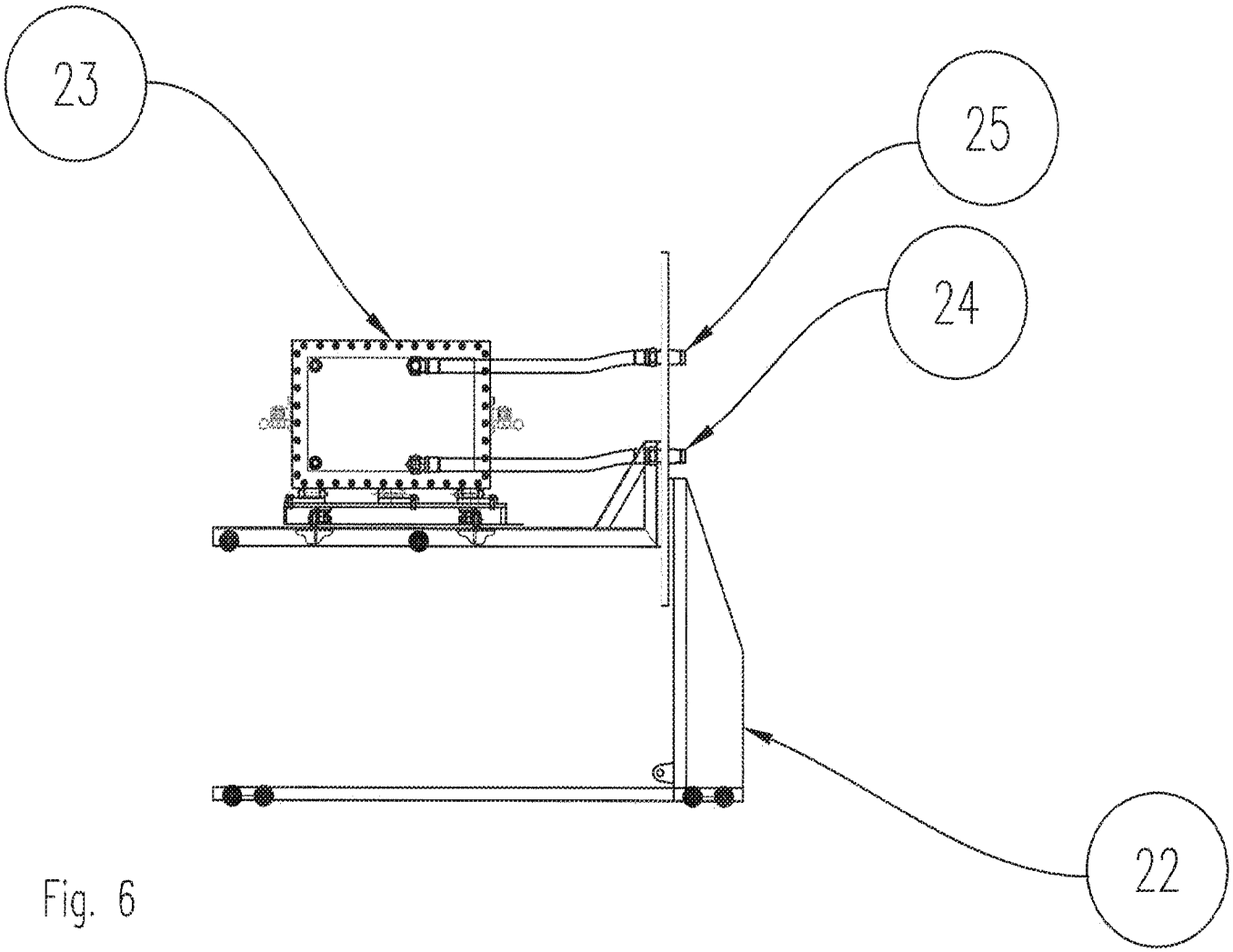
FIG. 6 is an expanded schematic of the book molding assembly shown in FIG. 5.

With reference to FIG. 5, the caster assembly may also include a book molding assembly 52 that includes a book mold 23. When the tundishes 21, 25 is positioned relative to the book molding assembly 52 so as to provide the material to the book mold 23, a bulk alloy may be formed.

During operation of the powder generating assembly 40, one or more of the flake generating assembly 50, and the book molding assembly 52, the flow management components 11, 12, 13, 14, in conjunction with control system 100, backfill the reaction chamber 2 with inert fluid. Material in pot 3 then flows to the tundish 21, 25 and then to one of the powder generating assembly 40, the flake generating assembly 50, and the book molding assembly 52. Control system 100 can be configured to control the speed of the wheel, speed of the inert gas or liquid media, temperature, pressure, and vacuum to optimize quantity, yield, and speed of production. In one example, a charge of 50 kg material in form of elements Nd, Fe, Dy, Tb, Al, Cu, Co, Pr, Ga was loaded in the reaction chamber 2 of the caster assembly 1. The reaction chamber 2 was evacuated three times and purged with inert gas (argon nitrogen) at least three times so that the oxygen level was non-detectable. The reaction chamber 2 was heated up to the melting temperature of NdFeB type material, i.e., 1470 degrees Celsius. The melted material was poured through tundish 25 into the jet of high velocity inert gas (argon nitrogen) producing spherical particles in the range of 100 nanometers to 3 micrometres. The ICP and elemental analysis on the composition of the spherical particles was:

TABLE 1

ICP Analyses for Composition, Triplicate Measurements

| Element | Wt % 1 | Wt % 2 | Wt % 3 | Element | Wt % 1 | Wt % 2 | Wt % 3 |
|---|---|---|---|---|---|---|---|
| Nd | 12.95 | 13.44 | 13.45 | Co | 20.69 | 19.27 | 19.28 |
| Fe | 2.21 | 1.88 | 1.90 | Pr | 0.13 | 0.07 | 0.08 |
| Dy | 59.27 | 61.54 | 61.50 | Ga | 0.19 | 0.19 | 0.18 |
| Tb | 0.24 | 0.25 | 0.25 | C | 0.01 | 0.01 | 0.01 |
| Al | 0.86 | 0.06 | 0.05 | O | 0.17 | 0.17 | 0.17 |
| Cu | 3.28 | 3.12 | 3.13 | | | | |

The following table reflects experiments that describe the relationship between atomization gas (Ar) pressure, particle size and cooling rates:

| Ex | Cooling rates (K/second) | Particle Size (mm) | Pressures (bar) |
|---|---|---|---|
| 1 | 1.00E+03 | 100-250 | 10 |
| 2 | 1.00E+04 | 80-100 | 20 |
| 3 | 1.00E+05 | 50-80 | 30 |
| 4 | 1.00E+06 | 10-40 | 50 |
| 5 | 1.00E+06 | 10-1 | 70 |
| 6 | 1.00E+06 | 0.5-1 | 80 |
| 7 | 1.00E+06 | 0.1-1 | 100 |

The following table depicts alloy production in the three different operating modes:

| TTC | Strip Caster | | | | Book Mold | | | | Atomizer | | | |
|---|---|---|---|---|---|---|---|---|---|---|---|---|
| ALLOY | S1 | S2 | S3 | S4 | S1 | S2 | S3 | S4 | S1 | S2 | S3 | S4 |
| PrNd | 0 | 0 | 1.0 | 0 | 0 | 0 | 1.2 | 0 | 0 | 0 | 1.0 | 0 |
| Nd | 23.71 | 0 | 0 | 0 | 23.69 | 0 | 0 | 0 | 23.8 | 0 | 0 | 0 |
| Pr | 0 | 15.2 | 0 | 0 | 0 | 14.9 | 0 | 0 | 0 | 14.7 | 0 | 0 |
| Dy | 6.00 | 60.8 | 30.0 | 15 | 5.93 | 60.8 | 30.4 | 15.1 | 5.95 | 60.3 | 29.8 | 14.5 |
| Tb | 0.13 | 0 | 5.0 | 5 | 0.13 | 0 | 4.9 | 4.8 | 0.12 | 0 | 5.1 | 5 |
| Co | 0.35 | 20 | 30.0 | 10 | 0.35 | 21 | 29.5 | 10.2 | 0.30 | 20 | 30.0 | 9.7 |
| Cu | 1.15 | 3 | 1.0 | 1 | 0.14 | 3 | 1.1 | 0.9 | 0.18 | 3.5 | 1.1 | 1.3 |
| Zr | 0 | 0 | 0 | 0 | 0.35 | 0 | 0 | 0 | 0 | 0 | 0 | 0 |
| V | 0 | 0 | 0 | 0 | 0 | 0 | 0 | 0 | 0.34 | 0 | 0 | 0 |
| Ga | 0 | 0 | 0 | 0 | 0.52 | 0 | 0 | 0 | 0 | 0.5 | 0 | 0 |
| Ti | 0 | 0 | 0 | 0 | 0 | 0 | 0 | 0 | 0.15 | 0 | 0 | 0 |
| Nb | 0 | 0 | 0 | 0 | 0 | 0 | 0 | 0 | 0.16 | 0 | 0 | 0 |
| C | 0.03 | 0 | 0 | 0 | 0.03 | 0 | 0 | 0 | 0.03 | 0 | 0 | 0 |
| O | 0.01 | 0 | 0 | 0 | 0.01 | 0 | 0 | 0 | 0.01 | 0 | 0 | 0 |
| Gd | 0.32 | 0 | 0 | 0 | 0.35 | 0 | 0 | 0 | 0.56 | 0 | 0 | 0 |
| Fe | 68.3 | 1 | 33.0 | 69 | 68.5 | 1 | 32.9 | 69 | 68.4 | 1 | 33.0 | 69.5 |

The following table depicts homogeneity versus particle size for the powder generating assembly 40:

| TTC | 100 nm | 1 μm | 3 μm | 50 μm | 100 μm | 200 μm | 500 μm |
|---|---|---|---|---|---|---|---|
| PrNd | 0.000 | 0.010 | 0.000 | 0.010 | 0.000 | 0.000 | 0.000 |
| Nd | 11.575 | 11.495 | 11.531 | 11.523 | 11.514 | 11.588 | 11.560 |
| Pr | 0.850 | 0.954 | 0.783 | 0.906 | 0.692 | 0.797 | 0.885 |
| Dy | 20.923 | 20.887 | 20.846 | 20.549 | 20.329 | 20.795 | 20.753 |
| Tb | 21.104 | 21.141 | 20.932 | 21.509 | 21.574 | 21.130 | 21.505 |
| Co | 37.956 | 38.068 | 38.399 | 38.263 | 38.306 | 38.178 | 37.752 |
| Cu | 5.568 | 5.423 | 5.497 | 5.251 | 5.569 | 5.500 | 5.531 |
| Zr | 0.000 | 0.000 | 0.000 | 0.000 | 0.000 | 0.000 | 0.000 |
| V | 0.000 | 0.000 | 0.000 | 0.000 | 0.000 | 0.000 | 0.000 |
| Ga | 0.000 | 0.000 | 0.000 | 0.000 | 0.000 | 0.000 | 0.000 |
| Ti | 0.000 | 0.000 | 0.000 | 0.000 | 0.000 | 0.000 | 0.000 |
| Nb | 0.000 | 0.000 | 0.000 | 0.000 | 0.000 | 0.000 | 0.000 |
| C | 0.001 | 0.001 | 0.001 | 0.000 | 0.000 | 0.001 | 0.001 |
| O | 0.001 | 0.001 | 0.000 | 0.001 | 0.000 | 0.000 | 0.001 |
| Al | 0.000 | 0.000 | 0.000 | 0.000 | 0.000 | 0.000 | 0.000 |
| Mn | 0.000 | 0.000 | 0.000 | 0.000 | 0.000 | 0.000 | 0.000 |
| Gd | 0.000 | 0.000 | 0.000 | 0.000 | 0.000 | 0.000 | 0.000 |
| Fe | 2.023 | 2.020 | 2.012 | 1.989 | 2.017 | 2.010 | 2.012 |

The following table depicts representative compositions produced using the flake generating assembly 50:

| TTC | S4 | S5 | S6 |
|---|---|---|---|
| PrNd | 0 | 24.67 | 0 |
| Nd | 8.84 | 0 | 8.89 |
| Pr | 2.97 | 0 | 3.28 |
| Dy | 42.2 | 29.3 | 42.7 |
| Tb | 0 | 0 | 0 |
| Co | 38.21 | 38.4 | 37.9 |
| Cu | 5.27 | 5.01 | 5 |

-continued

| TTC | S4 | S5 | S6 |
|---|---|---|---|
| Zr | 0.05 | 0.2 | 0.1 |
| V | 0 | 0.1 | 0.1 |
| Ga | 0 | 0.05 | 0.1 |
| Ti | 0 | 0.1 | 0.1 |
| Nb | 0 | 0.1 | 0.1 |
| C | 0.001 | 0.001 | 0.001 |
| O | 0.001 | 0.001 | 0.001 |
| Ga | 0 | 0 | 0 |
| Al | 0 | 0 | 0 |
| Mn | 0 | 0 | 0 |
| Gd | 0.5 | 0.05 | 0 |
| Fe | 1.958 | 2.018 | 1.728 |

The following table depicts shows representative compositions produced using the book molding assembly 52:

| TTC | NdFeB | SS1 | SS2 | MC1 | MC2 | DMM1 | DMM2 | DMM3 |
|---|---|---|---|---|---|---|---|---|
| PrNd | 0 | 0 | 0 | 0 | 0 | 0 | 0 | 0 |
| Nd | 28.79 | 0 | 0 | 0 | 0 | 0 | 0 | 0 |
| Pr | 0.26 | 0 | 0 | 0 | 0 | 0 | 0 | 0 |
| Dy | 1.66 | 0 | 0 | 0 | 55.2 | 0 | 0 | 0 |
| Ti | 0 | 0 | 0 | 0 | 0 | 78.6 | 76.2 | 0 |

-continued

| TTC | NdFeB | SS1 | SS2 | MC1 | MC2 | DMM1 | DMM2 | DMM3 |
|---|---|---|---|---|---|---|---|---|
| Co | 3.37 | 0 | 0 | 0 | 0 | 0 | 0 | 0 |
| Cu | 0.15 | 0 | 0 | 0 | 0 | 0 | 0 | 0 |
| Zr | 0 | 0 | 0 | 0 | 0 | 0 | 0 | 71.4 |
| B | 0.93 | 0 | 0 | 0 | 0 | 0 | 0 | 0 |
| V | 0 | 0 | 0 | 0 | 0 | 0 | 5.4 | 0 |
| Ga | 0.03 | 0 | 0 | 0 | 0 | 0 | 0 | 0 |
| Si | 0 | 1 | 0.75 | 0 | 0 | 0 | 0 | 0 |
| Cr | 0 | 17 | 15 | 0 | 0 | 0 | 0 | 0 |
| Ni | 0 | 12 | 8 | 0 | 0 | 0 | 0 | 0 |
| Mo | 0 | 2.5 | 2 | 0 | 0 | 0 | 0 | 0 |
| O | 0 | 0 | 0 | 27.4 | 26.7 | 0 | 0 | 28.6 |
| Al | 0.25 | 0 | 0 | 0 | 18.1 | 14.7 | 18.4 | 0 |
| Mn | 0.06 | 2.0 | 2 | 28.6 | 0 | 0 | 0 | 0 |
| Ni | 0 | 0 | 10 | 0 | 0 | 0 | 0 | 0 |
| C | 0 | 0.08 | 0.03 | 0 | 0 | 0 | 0 | 0 |
| Ca | 0 | 0 | 0 | 11.4 | 0 | 0 | 0 | 0 |
| S | 0 | 0.03 | 0.03 | 0 | 0 | 0 | 0 | 0 |
| Nb | 0 | 0 | 0 | 0 | 0 | 6.6 | 0 | 0 |
| P | 0 | 0 | 0.045 | 0 | 0 | 0 | 0 | 0 |
| La | 0 | 0 | 0 | 32.6 | 0 | 0 | 0 | 0 |
| Fe | 64.5 | 65.39 | 62.145 | 0 | 0 | 0 | 0 | 0 |

The caster assembly as disclosed herein, including any of its embodiments, are useful for producing particles as described in co-pending U.S. patent application Nos. 16/325,865, filed Aug. 16, 2017, now U.S. Pat. No. 11,213,890; and Ser. No. 10/926,333, filed Aug. 16, 2017, now U.S. Pat. No. 10,926,333, filed the same date as this application, and titled "Sub-Micron Particles Of Rare Earth And Transition Metals And Alloys, Including Rare Earth Magnet Materials." The content of this co-pending application is incorporated by reference herein, in its entirety for all purposes, or at least for the descriptions of the powders prepared and the specific conditions and equipment configurations to prepare the same.

The following listing of Embodiments is intended to complement, rather than displace or supersede, the previous descriptions.

Embodiment 1. A caster assembly configured to process and store a material, the assembly comprising:

(a) a reaction chamber in which the material is processed, the chamber comprising:

(i) a vessel configured to hold the material in a melted state prior to processing;

(ii) a powder generating assembly configured to receive the material from the melting vessel, the powder generating assembly comprising:

(aa) a feeding chamber; and (bb) a feeding device disposed at least partially within the feeding chamber, the feeding device comprising at least one nozzle configured to inject fluid, where the fluid is a gas, liquid, or combination of the two, into the feeding chamber, the feeding device further comprising a material inlet through which the material is configured to flow into the feeding chamber to be exposed to the inert fluid; and (b) a storage assembly configured to store the material, the storage assembly comprising:

(i) a storage container;

(ii) a manifold that connects the feeding device to the storage container; and (iii) a valve that controls flow of the material from the feeding device to the storage container through the manifold; and (c) a blower assembly, the blower assembly configured to provide the inert fluid through the at least one nozzle to form the material and transport the material to the storage container, wherein at least the reaction chamber and the storage assembly form a gas-tight seal from ambient gas surrounding the caster assembly.

Embodiment 2. The caster assembly of Embodiment 1, wherein the material a metal, a metallic alloy, or a mixture thereof.

Embodiment 3. The caster assembly of Embodiment 1 or 2, further comprising a temperature control assembly comprising one or both of a thermal imaging device and a pyrometer calibrated by a thermocouple.

Embodiment 4. The caster assembly of any one of Embodiments 1 to 3, further comprising a port configured to provide for injection of additional material.

Embodiment 5. The caster assembly of Embodiment 4, further comprising a telescoping arm configured to connect the port to the vessel.

Embodiment 6. The caster assembly of any one of Embodiments 1 to 5, wherein the storage assembly further comprises a force transducer configured to measure a weight of material in the storage container.

Embodiment 7. The caster assembly of any one of Embodiment 1 to 6, wherein the blower assembly further comprises a filter.

Embodiment 8. A reaction chamber for a caster assembly configured to process material, the reaction chamber comprising:

(a) a tundish configured to hold the material in a melted state prior to processing; and one, two or more of:

(b) a powder generating assembly configured to selectively receive material from the tundish, the powder generating assembly comprising (i) a feeding chamber; and (ii) a feeding device disposed at least partially within the feeding chamber, the feeding device comprising at least one nozzle configured to inject inert fluid, where the fluid is a gas, liquid, or combination of the two into the feeding chamber, the feeding device further comprising a material inlet through which the material is configured to flow into the feeding chamber to be exposed to the inert fluid;

(c) a flake generating assembly comprising a wheel configured to selectively receive material from the tundish; and (d) a book molding assembly comprising a book mold.

Embodiment 9. The reaction chamber of Embodiment 8 having all three of the powder generating assembly, the flake generating assembly and the book molding assembly.

Embodiment 10. The reaction chamber of Embodiment 8 or 9, wherein the material comprises a metal, a metallic alloy, or a mixture thereof.

Embodiment 11. The reaction chamber of any one of Embodiments 8 to 10, further comprising a control system configured to remotely control a position of the tundish relative to one of the powder generating assembly, the flake generating assembly, and/or the book molding assembly in order to process the material.

Embodiment 12. The reaction chamber of any one of Embodiments 8 to 11, wherein the control system further comprises multiple sensors disposed within the chamber, the multiple temperature sensors configured to provide three-dimensional dynamic mapping of one or more of pressure, temperature, and emissivity of hot and cold spots within the chamber.

Embodiment 13. The reaction chamber of any one of Embodiment 8 to 12, wherein the wheel is coated with a coating that includes a transition metal, preferably silver.

Embodiment 14. The reaction chamber of any one of Embodiments 8 to 13, wherein the silver coating has a thickness of at least 100 micrometers.

Embodiment 15. A caster assembly configured to process and store material, the assembly comprising:

a reaction chamber in which the material is processed, the chamber comprising:

a vessel configured to hold the material in a melted state prior to processing;

a powder generating assembly configured to receive material from the melting vessel, the powder generating assembly comprising:

(i) a feeding chamber that defines an outlet 33' that has a centerpoint C' and lies in a plane P, the feeding chamber 33 extending vertically about a center axis C that is perpendicular to plane P and includes centerpoint and (ii) a feeding device disposed at least partially within the feeding chamber, the feeding device comprising at least a first nozzle and a second nozzle, the first nozzle configured to inject a first inert fluid into the feeding chamber in a first direction, where the first inert fluid is a gas, liquid, or combination of the two, and the second nozzle configured to inject a second inert fluid into the feeding chamber in a second direction, where the second inert fluid is a gas, liquid, or combination of the two and the second inert fluid is the same as or different from the first inert fluid, the first direction being different from the second direction, the feeding device further comprising a material inlet through which the material is configured to flow into the feeding chamber in a third direction to be exposed to at least the first and second inert fluids.

Embodiment 16. The caster assembly of Embodiment 15, wherein the material is a metal, a metallic alloy, or a mixture thereof.

Embodiment 17. The caster assembly of Embodiment 15 or 16, wherein the first direction includes a radial component such that the first direction extends at least partially away from the center axis and the second direction includes a tangential component such that the second direction extends at least partially about the center axis.

Embodiment 18. The caster assembly of any one of Embodiments 15 to 17, wherein the third direction includes an axial component such that the third direction extends at least partially downward along the center axis.

Embodiment 19. The caster assembly of any one of Embodiments 15 to 18, where the feeding device further comprises a third nozzle configured to inject inert fluid, where the fluid is a gas, liquid, or combination of the two into the feeding chamber in a fourth direction, the fourth direction including an axial component such that the fourth direction extends at least partially downward along the center axis and the fourth direction also optionally includes a radial component such that the fourth direction also extends radially inwardly.

Embodiment 20. The caster assembly of any one of Embodiments 15 to 19, further comprising:

(c) a storage assembly configured to store the material, the storage assembly comprising:

(i) a storage container;

(ii) a manifold that connects the feeding device to the storage container; and (iii) a valve that controls flow of the material from the feeding device to the storage container through the manifold; and (d) a blower assembly, the blower configured to provide inert fluid, where the fluid is a gas, liquid, or combination of the two through the at least one nozzle to form the material and transport the material to the storage container.

Embodiment 21. The caster assembly of any one of Embodiments 15 to 20, wherein the material inlet is disposed downstream of the first nozzle and the second nozzle.

Features of the disclosure which are described above in the context of separate embodiments may be provided in combination in a single embodiment. Conversely, various features of the disclosure that are described in the context of a single embodiment may also be provided separately or in any subcombination.

Changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the claims.

What is claimed:

1. A caster assembly comprising:

a powder generating assembly configured to receive a material from a melting vessel, the powder generating assembly comprising:

(aa) a feeding chamber; and (bb) a feeding device disposed at least partially within the feeding chamber, the feeding device comprising at least one nozzle configured to inject inert fluid, where the inert fluid is a gas, liquid, or combination of the two, into the feeding chamber, the feeding device further comprising a material inlet through which the material is configured to flow into the feeding chamber to be exposed to the inert fluid;

a flake generating assembly comprising a wheel configured to selectively receive the material; and a book molding assembly comprising a book mold.

2. The caster assembly of claim 1, wherein the material comprises a metal, a metallic alloy, or a mixture thereof.

3. The caster assembly of claim 1, further comprising a temperature control assembly comprising one or both of a thermal imaging device and a pyrometer calibrated by a thermocouple.

4. The caster assembly of claim 1, further comprising:

a reaction chamber in which the material is processed, the reaction chamber comprising the melting vessel configured to hold the material in a melted state prior to processing;

a storage assembly configured to store the material, the storage assembly comprising:

(i) a storage container;

(ii) a manifold that connects the feeding device to the storage container; and (iii) a valve that controls flow of the material from the feeding device to the storage container through the manifold; and a blower assembly, the blower configured to provide the inert fluid through the at least one nozzle to form the material and transport the material to the storage container.

5. The caster assembly claim 4, further comprising a port configured to provide for injection of additional material; the port being located on a top or side of the reaction chamber.

6. The caster assembly of claim 5, further comprising a telescoping arm configured to connect the port to the vessel.

7. The caster assembly of claim 4, wherein the storage assembly further comprises a force transducer configured to measure a weight of material in the storage container.

8. The caster assembly of claim 4, wherein the blower assembly further comprises a filter.

9. The caster assembly of claim 1, further comprising a control system configured to remotely control a position of a tundish relative to the powder generating assembly in order to process the material.

10. The caster assembly of claim 9, wherein the control system further comprises multiple sensors disposed within the chamber, the multiple temperature sensors configured to provide three-dimensional dynamic mapping of one or more of pressure, temperature, and emissivity of hot and cold spots within the chamber.

11. The caster assembly of claim 1, wherein the wheel is coated with a coating that includes a metal.

12. The caster assembly of claim 11, wherein the coating has a thickness of at least 100 micrometers.

13. The caster assembly of claim 11, wherein the metal comprises silver.

14. The caster assembly of claim 4, wherein at least the reaction chamber and the storage assembly form a gas-tight seal from ambient gas surrounding the caster assembly.

* * * * *